US008062198B2

(12) United States Patent
Wei

(10) Patent No.: US 8,062,198 B2
(45) Date of Patent: Nov. 22, 2011

(54) INVERSION TABLE

(75) Inventor: Kenny Wei, Daya Township, Taichung County (TW)

(73) Assignee: Paradigm Inc., Taichung (TW)

( * ) Notice: Subject to any disclaimer, the term of this patent is extended or adjusted under 35 U.S.C. 154(b) by 0 days.

(21) Appl. No.: 12/763,935

(22) Filed: Apr. 20, 2010

(65) Prior Publication Data

US 2011/0256993 A1 Oct. 20, 2011

(51) Int. Cl.
*A63B 21/00* (2006.01)

(52) U.S. Cl. ..... 482/144; 482/907; 482/145

(58) Field of Classification Search ..... 482/144
See application file for complete search history.

(56) References Cited

U.S. PATENT DOCUMENTS 6,422,982 B1 * 7/2002 Retel ..... 482/144
7,500,939 B2 * 3/2009 Chen ..... 482/144
2007/0169268 A1 * 7/2007 Lemire et al. ..... 5/617
2008/0207413 A1 * 8/2008 Gonzalez ..... 482/144
2009/0054217 A1 * 2/2009 Teeter ..... 482/144

* cited by examiner

*Primary Examiner* — Jerome W Donnelly
(74) *Attorney, Agent, or Firm* — Pai Patent & Trademark Law Firm; Chao-Chang David Pai

(57) ABSTRACT

An inversion table has a mounting bracket, a backrest, an ankle clamp assembly and a heating device. The mounting bracket has a rear supporting frame and two front supporting legs to form a triangle. The rear supporting frame has two pivotal points. The backrest is pivotally connected to the pivotal points and has a connecting arm. The ankle clamp assembly is connected to the connecting arm of the backrest to clamp and hold a user's ankles. The heating device is connected to the mounting bracket and the backrest and has a heating panel, a controller and a power cord. The heating panel is mounted in the backrest. The controller is electrically connected to the heating panel to control the temperature of the heating panel and is securely mounted on a rear side of the backrest. The power cord is electrically connected to the controller to transport electricity to the controller.

9 Claims, 4 Drawing Sheets

INVERSION TABLE

BACKGROUND OF THE INVENTION

1. Field of the Invention

The present invention relates to an inversion table, and more particularly to an inversion table that can provide a heating effect to users.

2. Description of Related Art

Conventional exercising machines, such as exercising bikes, treadmills and surfing machines have mechanical structures and linkage shafts to simulate exercise dynamics to exercise at least one muscle group for training, rehabilitation or the like. A conventional inversion table can relax or relieve back pain of a user and has a mounting bracket, a backrest and an ankle clamp assembly. The backrest is pivotally attached to the mounting bracket. The ankle clamp assembly is connected to the backrest to clamp and hold the user's ankles when the backrest is pivoted to an inverted position.

When the conventional inversion table is in use, the backrest only can be rotated at a specified inverted angle to obtain an inversion effect. However, the inversion effect provided by the conventional inversion table is not sufficient to achieve an optimal effect for accelerating the blood circulation and relaxing muscles of the user.

The invention provides an inversion table that mitigates or obviates the aforementioned problems.

SUMMARY OF THE INVENTION

The main objective of the present invention is to provide an inversion table that can provide a heating effect for the user.

The inversion table in accordance with the present invention has a mounting bracket, a backrest, an ankle clamp assembly and a heating device. The mounting bracket has a rear supporting frame and two front supporting legs to form a triangle. The rear supporting frame has two pivotal points. The backrest is pivotally connected to the pivotal points of the rear supporting frame and has a connecting arm. The ankle clamp assembly is securely connected to the connecting end of the connecting arm of the backrest to clamp and hold a user's ankles. The heating device is connected to the mounting bracket and the backrest and has a heating panel, a controller and a power cord. The heating panel is mounted in the backrest. The controller is electrically connected to the heating panel to control the temperature and the heating time of the heating panel and is securely mounted on a rear side of the backrest. The power cord is electrically connected to the controller to transport electricity to the controller.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
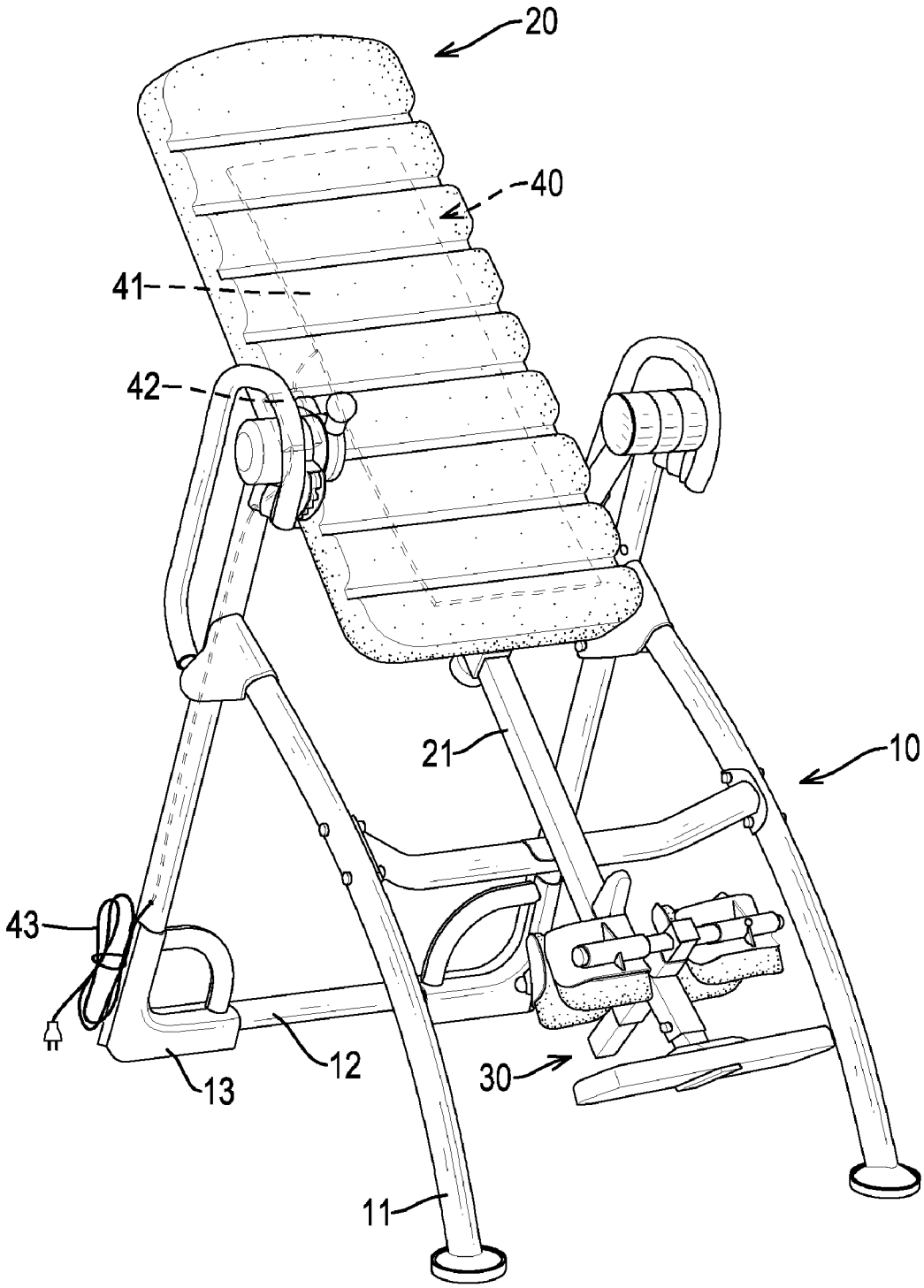
FIG. 1 is a perspective view of an inversion table in accordance with the present invention.
Figure 2:
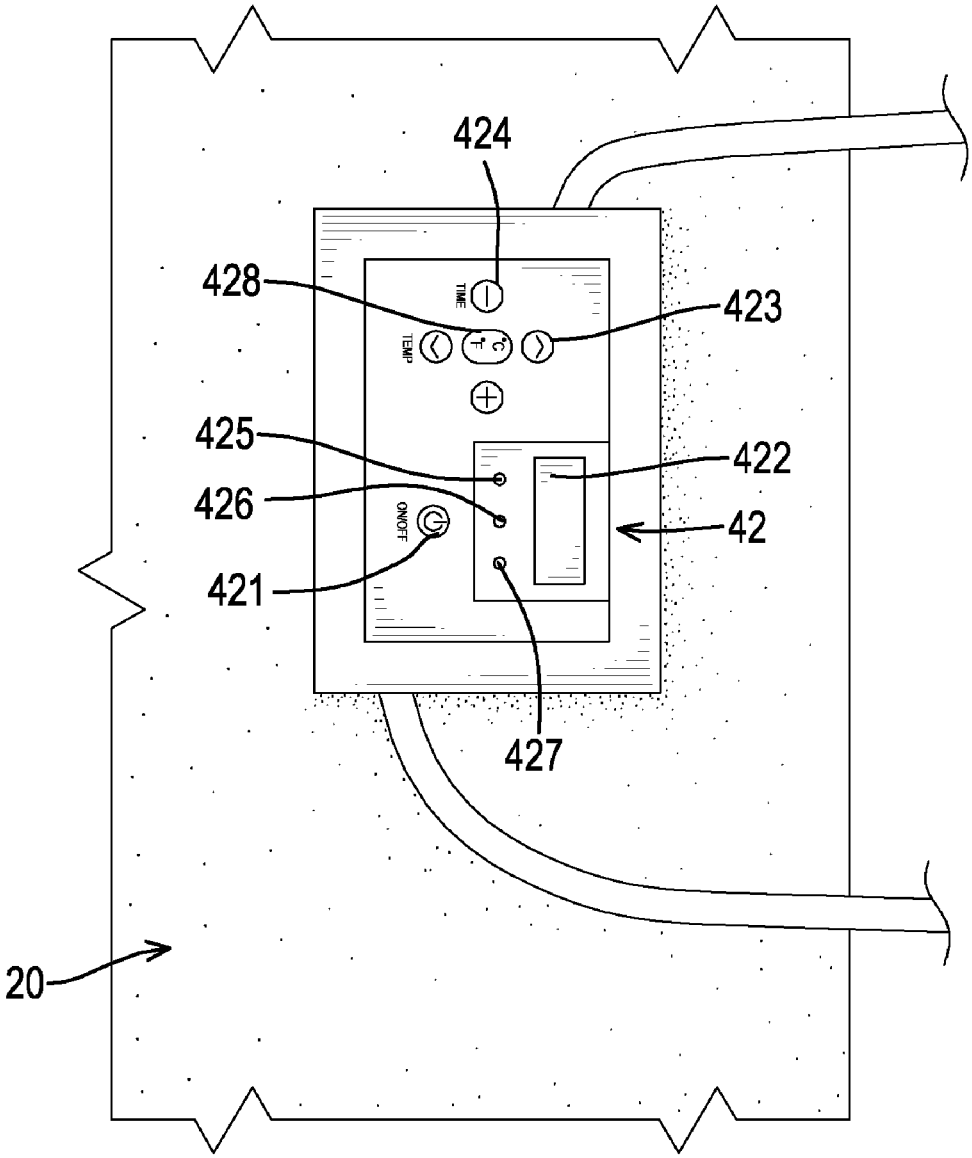
FIG. 2 is an enlarged side view of a controller of the inversion table in FIG. 1.

With reference to FIG. 1, an inversion table in accordance with the present invention has a mounting bracket (10), a backrest (20), an ankle clamp assembly (30) and a heating device (40).

The mounting bracket (10) has a rear supporting frame (12) and two front supporting legs (11) to form the mounting bracket (10) as a triangular structure. The rear supporting frame (12) may be U-shaped and has a bottom side, two free ends and two pivotal points. The pivotal points are respectively mounted on the free ends of rear supporting frame (12) and face to each other. The front supporting legs (11) are securely attached to the rear supporting frame (12) respectively near the free ends. Preferably, the mounting bracket (10) has two handles (13) mounted on the bottom side of the rear supporting frame (12) to provide a holding and gripping effect.

The backrest (20) is pivotally connected to the pivotal points of the rear supporting frame (12) of the mounting bracket (10) and has a bottom end, a rear side and a connecting arm (21). The connecting arm (21) is adjustably connected to the bottom end of the backrest (20) and has a connecting end.

The ankle clamp assembly (30) is securely connected to the connecting end of the connecting arm (21) of the backrest (20) to clamp and hold user's ankles.

With reference to FIGS. 1, 2, 3A and 3B, the heating device (40) is connected to the mounting bracket (10) and the backrest (20) and has a heating panel (41), a controller (42), a power cord (43) and a remote control (44).

The heating panel (41) may be a rectangular carbon fiber electrical hot plate and is mounted in the backrest (20).

The controller (42) is electrically connected to the heating panel (41) to control the temperature and the heating time of the heating panel (41), is securely mounted on the rear side of the backrest (20) and has an inner side, an outer side, a power switch (421), a display (422), multiple adjusting buttons (423, 424) and a temperature switch button (428). The inner side of the controller (42) is securely mounted on the rear side of the backrest (20). The power switch (421) is mounted on the outer side of the controller (42).

The display (422) is mounted on the outer side of the controller (42) near the power switch (421) and has an outer side, a temperature indicating button (425), a time indicating button (426) and a power indicating button (427). The buttons (425, 426, 427) are mounted on the outer side of the display (422) to allow the temperature and the heating time of the heating panel (41) and the power source of the controller (42) to be shown on the display (422).

The adjusting buttons (423, 424) are mounted on the outer side of the controller (42) to adjust the temperature and the heating time of the heating panel (41). Preferably, the controller (42) has two temperature adjusting buttons (423) and two time adjusting buttons (424).

The temperature switch button (428) is mounted on the outer side of the controller (42) between the adjusting buttons (423, 424) to switch different temperature scales shown on the display (422) such as Fahrenheit degree or centigrade degree.

The power cord (43) is electrically connected to the controller (42) to transport electricity to the controller (42) and has two ends. One of the ends of the power cord (43) is electrically connected to the controller (42) and the other end of the power cord (43) is electrically connected to an outlet. Preferably, the end of the power cord (43) that opposites to the controller (42) is mounted in the rear supporting frame (12) and extends out of the rear supporting frame (12) near one of the handles (13).

The remote control (44) is wirelessly connected to the controller (42) to adjust the temperature and the heating time of the heating panel (41).

Figures 3A, 3B:
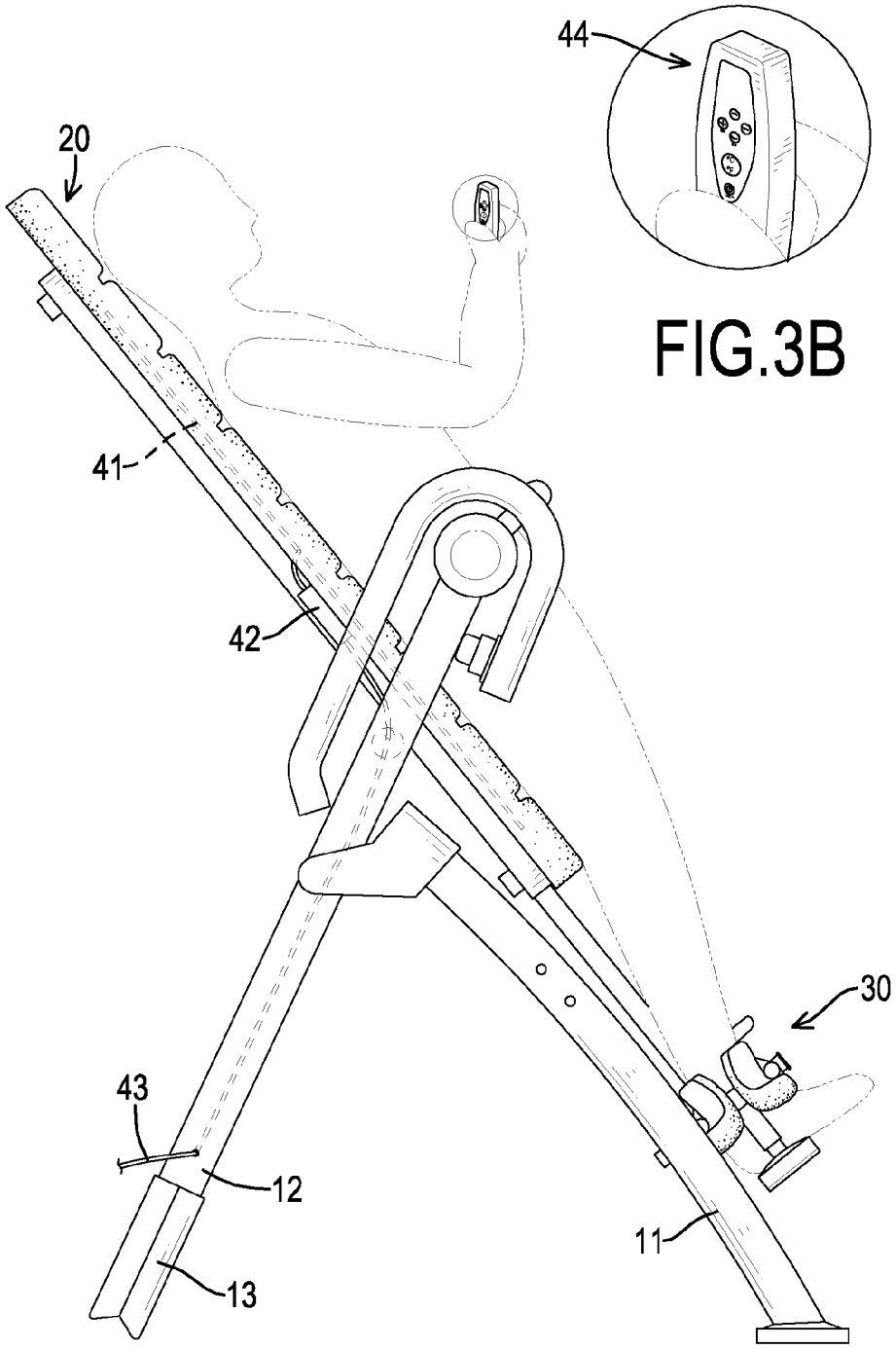
FIG. 3A is an operational side view of the inversion table in FIG. 1.
FIG. 3B is an enlarged perspective view of a remote control of the inversion table in accordance with the present invention.
Figure 4:
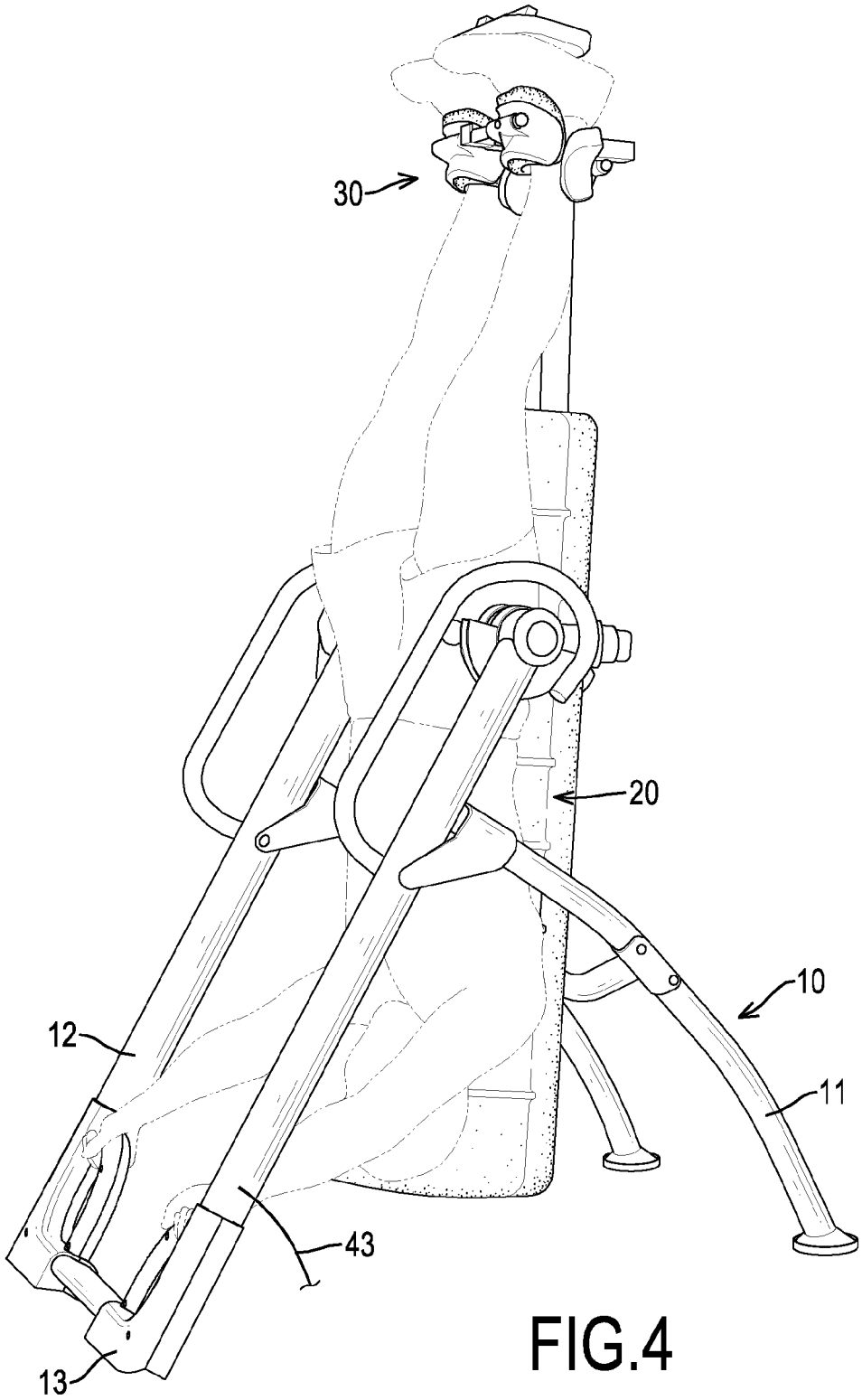
FIG. 4 is an operational perspective view of the inversion table in FIG. 1.

With reference to FIGS. 3A, 3B and 4, when a user uses the inversion table to invert, the user can push the handles (13) with hands to make the backrest (20) substantially perpendicular to the ground. During the period of inversion, the heating panel (41) can be actuated to generate heat energy and the temperature and the heating time of the heating panel (41) can be adjusted by pressing the adjusting buttons (423, 424) of the controller (42) or the remote control (44). With the heat provided by the heating panel (41), the blood circulation of the user can be accelerated and this can provide an optimum inversion effect to the user.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An inversion table having
- a mounting bracket;
  - a rear supporting frame having
    - a bottom side;
    - two free ends; and
    - two pivotal points respectively mounted on the free ends of the rear supporting frame and facing each other; and
  - two front supporting legs securely attached to the rear supporting frame respectively near the free ends to form a triangular mounting bracket;
- a backrest pivotally connected to the pivotal points of the rear supporting frame of the mounting bracket and having
  - a bottom end;
  - a rear side; and
  - a connecting arm adjustably connected to the bottom end of the backrest and having a connecting end;
- an ankle clamp assembly securely connected to the connecting end of the connecting arm of the backrest to clamp and hold user's ankles; and
- a heating device connected to the mounting bracket and the backrest and having
  - a heating panel being a rectangular carbon fiber electrical hot plate and mounted in the backrest;
  - a controller electrically connected to the heating panel to control the temperature of the heating panel and securely mounted on the rear side of the backrest; and
  - a power cord electrically connected to the controller to transport electricity to the controller.

2. The inversion table as claimed in claim 1, wherein the controller has
- an inner side securely mounted on the rear side of the backrest;
- an outer side;
- a power switch mounted on the outer side of the controller;
- a display mounted on the outer side of the controller near the power switch and having
  - an outer side;
  - a temperature indicating button mounted on the outer side of the display to allow the temperature of the heating panel to be shown on the display;
  - a time indicating button mounted on the outer side of the display to allow the heating time of the heating panel to be shown on the display; and
  - a power indicating button mounted on the outer side of the display to allow the power source of the controller to be shown on the display; and
- a plurality of adjusting buttons mounted on the outer side of the controller to adjust the temperature and the heating time of the heating panel.

3. The inversion table as claimed in claim 2, wherein the plurality of adjusting buttons of the controller has
- two temperature adjusting buttons to adjust the temperature of the heating panel; and
- two time adjusting buttons to adjust the heating time of the heating panel; and the controller further has
- a temperature switch button mounted on the outer side of the controller between the plurality of adjusting buttons to switch different temperature scales shown on the display.

4. The inversion table as claimed in claim 3, wherein
- the mounting bracket has two handles mounted on the bottom side of the rear supporting frame to provide a holding and gripping effect; and
- the power cord has two ends, wherein one of the ends is electrically connected to the controller and the other end is electrically connected to an outlet.

5. The inversion table as claimed in claim 4, wherein the heating device has a remote control wirelessly connected to the controller to adjust the temperature and the heating time of the heating panel.

6. The inversion table as claimed in claim 1, wherein
- the mounting bracket has two handles mounted on the bottom side of the rear supporting frame to provide a holding and gripping effect; and
- the power cord has two ends, wherein one of the ends is electrically connected to the controller and the other end is electrically connected to an outlet.

7. The inversion table as claimed in claim 1, wherein the heating device has a remote control wirelessly connected to the controller to adjust the temperature and the heating time of the heating panel.

8. The inversion table as claimed in claim 7, wherein the controller has
- two temperature adjusting buttons to adjust the temperature of the heating panel;
- two time adjusting buttons to adjust the heating time of the heating panel; and
- a temperature switch button mounted on the outer side of the controller between the adjusting buttons to switch different temperature scales shown on the display.

9. The inversion table as claimed in claim 8, wherein
- the mounting bracket has two handles mounted on the bottom side of the rear supporting frame to provide a holding and gripping effect; and
- the power cord has two ends, wherein one of the ends is electrically connected to the controller and the other end of the power cord is electrically connected to an outlet.

* * * * *